United States Patent [19]

Toepffer

[11] 4,312,142

[45] Jan. 26, 1982

[54] DEVICE FOR PREPARING THE SURFACE OF ICE RINKS

[76] Inventor: Daniel H. Toepffer, Schwedenstrasse 70, D-8000 Muenchen 40, Fed. Rep. of Germany

[21] Appl. No.: 108,083

[22] Filed: Dec. 28, 1979

[30] Foreign Application Priority Data

Dec. 28, 1978 [DE] Fed. Rep. of Germany ..... 2856492

[51] Int. Cl.[3] ..... E01H 1/02; B05B 3/00

[52] U.S. Cl. ..... 37/1; 37/41; 239/208; 239/711; 404/111

[58] Field of Search ..... 37/1 R, 41 R, 42 R; 239/208, 209, 210, 711; 404/111

[56] References Cited

U.S. PATENT DOCUMENTS 2,973,591 7/1961 Lull ..... 37/41

3,608,827 9/1971 Kinkead ..... 239/711

4,125,915 11/1978 Zamboni ..... 37/43 R X

*Primary Examiner*—E. H. Eickholt

*Attorney, Agent, or Firm*—William A. Drucker

[57] ABSTRACT

In a mobile device for preparing the surfaces of ice-rinks with an essentially rectangular rink, an ice-scraping device for the mechanical smoothing of the ice surface and a distributing device for the even application of a film of water on the ice surface are mounted on a framework which extends parallel to a first rink edge across the whole rink and is slidingly guided at its axial ends along the two rink edges running at right angles to the first rink edge. The framework is mounted in height-adjustable manner on supports which roll on rails outside the rink. A barrier section of a barrier enclosing the rink, which is erected at right angles to the direction of movement, can be displaced in the direction of movement so that ice scraped off by the ice-scraping device can be pushed into a trench outside the rink.

9 Claims, 6 Drawing Figures

DEVICE FOR PREPARING THE SURFACE OF ICE RINKS

BACKGROUND OF THE INVENTION

This invention relates to a mobile device for preparing the surface of artificial ice rinks with an essentially rectangular rink, incorporating at least one ice-scraping device for the mechanical smoothing of the ice surface and a distributing device for the even application of a film of water on the mechanically smoothed ice surface.

With artificial ice rinks it is necessary from time to time to prepare the surface of the ice after it has been used by skaters. The rink must be cleaned and renewed, so that a smooth and faultless ice surface is again available.

THE PRIOR ART

At present an ice-scraping machine as described for example in German Patent publication DE-AS 1096261 is normally employed for this purpose. With this ice-scraping machine, the ice-scraping device and the distributing device are mounted on a motor vehicle driven by an internal combustion engine. With such an ice-scraping machine the ice surface can only be machined in individual strips, so that preparing the ice takes a relatively long time, which is lost to the skating activity. Furthermore, this work can only be carried out by a trained driver, to prevent unmachined sections of the surface remaining between the individual strips or tracks of the ice-scraping machine, or other unevennesses occurring. The ice-rink must also have rounded corners for such an ice-scraping machine to be used, since the ice-scraping machine cannot drive into right-angled corners. As a result a proportion of the otherwise available rink is lost. Another disadvantage, which makes itself felt in enclosed halls in particular, is that the motor vehicle driven by an internal combustion engine pollutes the air in the hall with exhaust gases.

OBJECT OF THE INVENTION

The object of the invention is to provide a device of the type specified hereinabove by means of which the ice surface can be treated in a shorter time than hitherto and without the aid of specially trained staff.

SUMMARY OF THE INVENTION

To resolve this problem, it is proposed in accordance with the invention that the ice-scraping device and the distributing device be mounted on a framework which extends essentially parallel to a first rink edge across the whole rink and is slidingly guided at its axial ends along the two rink edges running essentially at right angles to the first rink edge.

The important advantage of the device according to the invention lies in the fact that the rink can now be treated over its whole width in a single operation. By this means, not only can the expenditure of time and effort on preparing the ice be reduced, but a considerably better quality of ice surface is also achieved, since the unevennesses between the strips which may occur as a result of the strip-wise driving of the traditional ice-scraping machine are avoided in all cases.

Finally, with the device according to the invention, it is possible also to treat the corners of a rectangular rink, so that these are available to the skaters.

The device according to the invention can by choice of a suitable drive arrangement be moved across the rink with uniform speed, as a result of which an exceptionally even ice surface is produced, without specially trained staff having been necessary.

The framework is preferably carried with its axial ends on supports which can travel parallel to the second rink edges. The supports can for instance also have wheels which run on rails, with which they can travel on guide rails which are laid parallel to the second rink edges. This produces a further advantage of the device according to the invention compared to the traditional ice-scraping machine. Since the traditional ice-scraping machine drives on the rink to be machined, unevennesses in the ice surface are transmitted through the vehicle to the implements being used to treat the ice surface, in particular the ice-scraping device. As a result of this there is the danger that the unevennesses already present in the ice surface, e.g. slight undulations, will be amplified or at least not levelled. With the device according to the invention on the other hand, the height of the ice-scraping device can be set to an absolutely constant level, since the device is guided on guides located outside the rink, such as for example rails.

As a rule the ice-rinks are surrounded by a barrier such as a balustrade or border. Consequently the means of guidance such as for example the guide rails must be laid outside the barrier. So that the device will not impede the skating activity when it is not required, it is expedient to mount the framework in height-adjustable manner at the supports, so that the framework can be raised above the barrier sections of the barrier which run parallel to the first rink edge.

As opposed to the traditional ice-scraping machine, which on account of strip running must be independent of supply facilities and consequently depends on a drive by means of an internal combustion engine, the device according to the invention can be connected to fixed supply connections by means of flexible supply leads. This enables the device to be driven by one or more electric motors, which not only ensure an exceptionally even running of the device, but can also operate very quietly and without producing injurious exhaust gases. Similarly it is possible to supply the distributing device for the application of a film of water to the ice surface by means of a water hose, so that no water tank needs to be mounted on the framework. The supply leads can be carried with the mobile device by means of well known arrangements such as sprocket chains or suitable reeling devices.

The ice-scraping device itself can essentially be designed in the traditional manner and can have at least one blade arranged parallel to the first rink edge. Instead of one blade extending across the whole rink, several blades can also be employed, which are arranged so that no unmachined surface will remain between them.

If necessary a collecting device for collecting the material scraped off by the blade or blades can be provided in a manner which is well known in itself. The distributing device preferably incorporates a spreader made from an absorbent material which extends across the ice-rink parallel to the first rink edge, e.g. a width of fabric, and a sprinkling device mounted above the spreader for saturating the spreader with water. As already stated, the sprinkling device can either be connected to a water tank mounted on the framework or by means of a flexible water hose to a water connection. This is particularly advantageous in view of the fact that hot water is normally used, to prevent the water freezing already in the sprinkling device.

The invention also concerns an artificial ice-rink with an essentially rectangular rink and a barrier surrounding the latter, which is designed according to the invention in such a way that means of guidance for a mobile device of the type described above are arranged along two mutually facing rink edges, that at least one of the barrier sections of the barrier running at right angles to the direction of travel of the device can be displaced parallel to the direction of travel, and that a trench is made in the floor extending parallel to the displaceable barrier section, within the displacement travel of the barrier section. With an artificial ice-rink design of this sort, a collecting device for collecting the material scraped off by the ice-scraping device can be dispensed with. The material scraped off is pushed by the ice-scraping device at the end of an operation into the trench, in which drains can be fitted, to allow the scraped off ice to flow away after it has melted.

Preferably the trench can be covered by a cover which can be opened or closed together with the displacement of the barrier section, so that the trench is only open during the machining of the ice surface, but is otherwise closed and presents no danger to the visitors to the artificial ice-rink.

If the means of guidance for the mobile device consist of rails laid on the floor outside the barrier, it is expedient to provide a covering arrangement, to cover the rails at least in the area of the doors fitted to the barrier, to give unimpeded access to the rink.

In order to be able to remove the ice-treatment device from the rink, at least one of the barrier sections erected at right angles to the direction of travel of the ice-processing device can be lowered into the floor. With the barrier section lowered, the ice-treatment device can drive off the rink, after which the barrier can be closed again by raising the barrier section.

Further features and advantages of the invention will be apparent from the following description which, taken in conjunction with the accompanying drawings, explains the invention with reference to some examples of embodiment.

DESCRIPTION OF THE PREFERRED EMBODIMENTS

Figure 1:
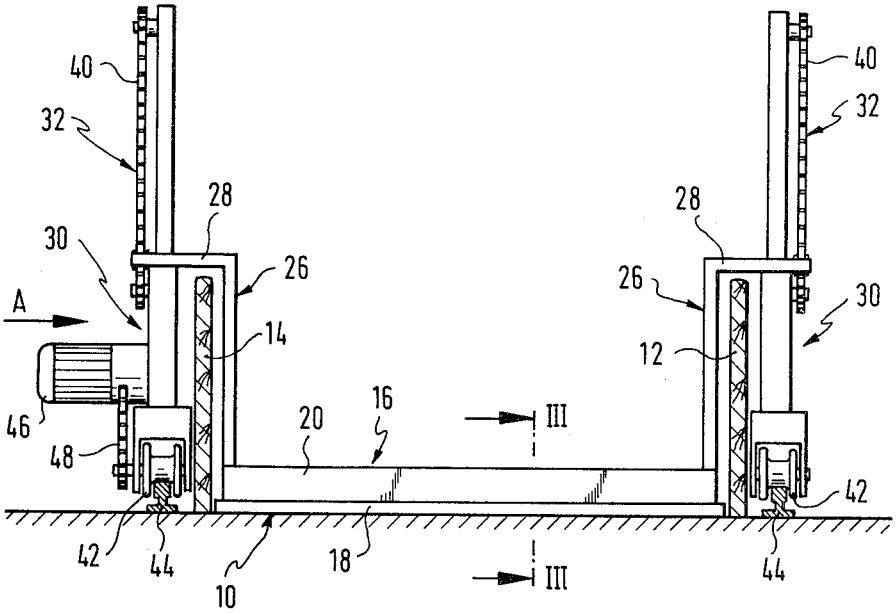
FIG. 1 is a diagrammatic cross-section through an artificial ice-rink at right angles to the ice surface, with a diagrammatically shown ice-processing device according to the invention.

In FIG. 1 there is shown a diagrammatically presented artificial ice-rink with an essentially rectangular rink 10, which is enclosed on its four rectangular sides in a traditional manner by a waist-high wooden wall, of which two barrier sections 12 and 14 which run parallel to one another are shown in FIG. 1.

At right angles to the barrier sections 12 and 14, the framework 16 of an ice-processing device extends across the whole of the rink.

Figure 3:
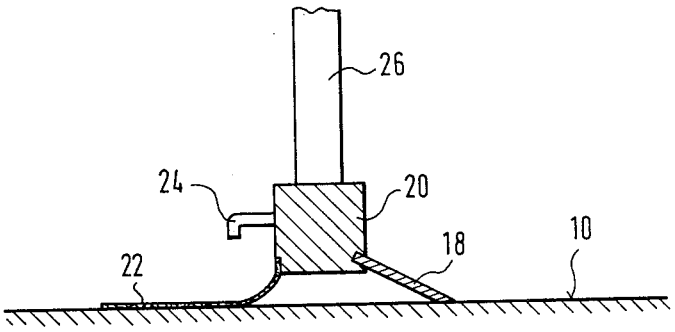
FIG. 3 is a diagrammatic section taken along the line III—III in FIG. 1.

An ice-scraping device and a distributing device for the application of a thin film of water on the scraped off ice surface are mounted on the framework. The ice-scraping device is diagrammatically indicated in FIG. 3 by means of a blade 18 which is fitted in such a manner to a longitudinal beam 20 of the framework 16 that it rests on the ice surface with its cutting edge at a specific angle. The blade 18 can consist of a single blade extending across the whole distance between the barrier sections 12 and 14, or also of several sub-blades which are so arranged that no areas occur between them in which the ice surface is not machined.

The distributing device incorporates a fabric spreader 22 fitted to the beam 20, the spreader also extending across the whole distance between the barrier sections 12 and 14, as well as a sprinkling or spraying device indicated by means of a pipe socket 24, from which water is applied to the fabric spreader 22 and distributed by the latter on the ice surface in the form of a fine film of water.

The longitudinal beam 20 extending over the whole distance between the barrier sections 12 and 14 is attached at its axial ends to vertical beams 26 which are suspended in height-adjustable manner on vertical supports 30 located outside the barrier sections 12 and 14 by means of horizontal side pieces 28 which engage over the top of the barrier sections 12 and 14. Height adjustment takes place by means of a chain drive 32 which incorporates an electric motor 34 with a sprocket wheel 36 mounted on its output shaft, another sprocket wheel 38 fitted at the top end of the support and a chain 40 led over the sprocket wheels 36 and 38, the ends of the chain being attached to the horizontal side pieces 28 of the vertical beam 26. The height of the supports 30 and the length of the chain drive 32 are so dimensioned that the framework 16 with the blade 18 can be raised above the top edge of the barrier.

Figure 2:
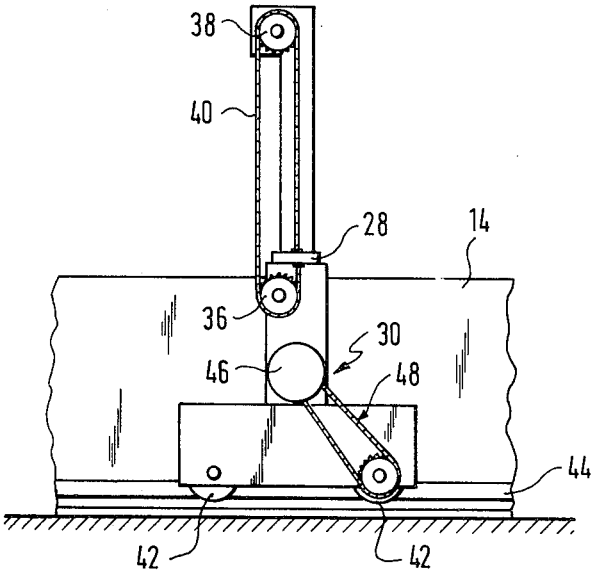
FIG. 2 is an enlarged side elevational viewed in the direction of the arrow A in FIG. 1.

The supports 30 rest in each case on rail wheels 42 (see FIG. 2 also) which are guided on guide rails 44 laid parallel to and outside the barrier sections 12,14. An electric motor 46 is fitted at the left hand support 30 in FIG. 1, which drives at least one of the rail wheels 42 by means of a chain drive 48.

The electric motor 46 can be supplied by a cable carried with it (not shown) or also by means of a conductor rail, provided that it is ensured that users of the artificial ice-rink cannot be endangered as a result.

Figure 4:
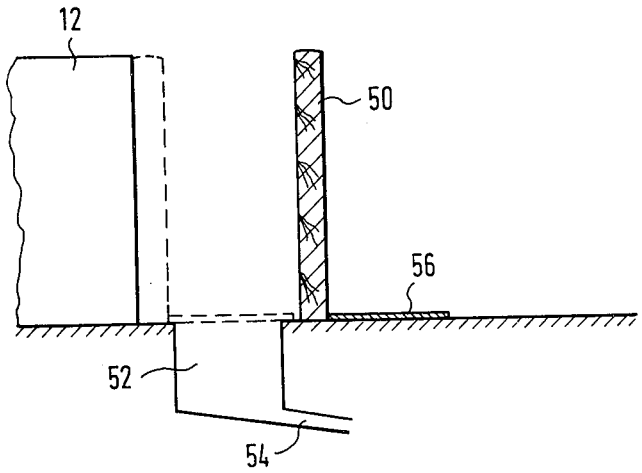
FIG. 4 is a diagrammatic partial section through the end of an artificial ice-rink taken parallel to the direction of travel of the ice-treatment device.

In FIG. 4 there is seen one end of the artificial ice-rink with a section through a barrier section 50 which is erected parallel to the longitudinal beam 20 and at right angles to the barrier sections 12 and 14. This barrier section 50 can be displaced between the positions shown in solid and dotted lines in FIG. 4 by means of a suitable shifting device which is not shown. In its dotted line position it borders directly on the rink 10 and, together with the barrier sections 12 and 14 and the opposite barrier section, forms a continuous barrier. In its pulled back position shown in solid lines it exposes a trench 52 made outside the rink 10 and running parallel to the barrier section 50, into which the material scraped off by the blade 18 can be pushed once the ice-treatment device has covered the rink. A drain 54 connected with the trench 52 ensures that the ice can flow away from the trench 52 after melting. When the barrier section 50 assumes its position indicated by dotted lines, the trench is closed off by means of a cover 56 which is connected to the barrier section 50 and can be displaced with it.

It should also be noted that the barrier section 50 or the barrier section opposite it can be lowered into the floor, so that the framework 16 with the ice-scraping device and the distributing device can be driven off the rink 10, after which the lowered barrier section can be raised out of the floor again. In this case it would be possible to dispense with the height adjustment, i.e. the chain drive 32. In this case, the vertical beams 26 of the framework 16 would be rigidly connected to the supports 30.

Preferably both the barrier section 50 as well as the barrier section opposite to it are designed to be displaceable and trenches 52 are made at both pertinent ends of the rink 10. Then the rink can be processed with a single passage of the ice-treatment device, without the device having to be driven to the other end of the ice-rink before the processing of the ice surface, or having to be driven back after the processing of the rink.

The above description shows that the ice-treatment device according to the invention can without trouble be so driven and controlled that it can be operated even by untrained staff. It should also be added that the device according to the invention can also be used with advantage in the making of a new rink.

Figure 5:
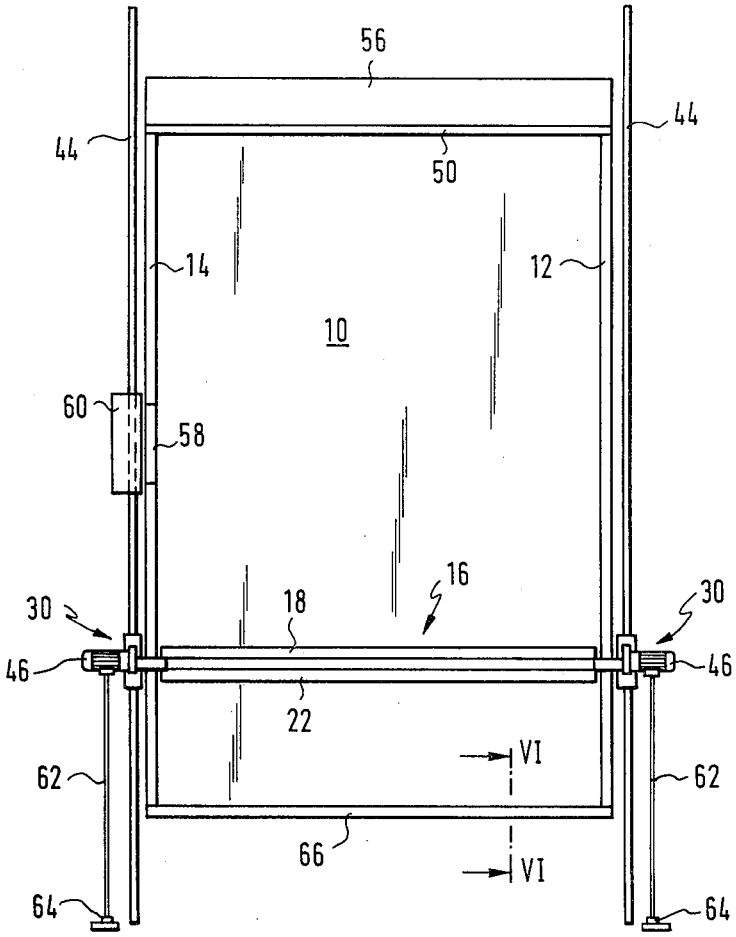
FIG. 5 is a diagrammatic plan view of an ice-rink according to the invention.

FIG. 5 shows a diagrammatic plan view of the ice-rink according to the invention and the device according to the invention for preparing the ice surface. The same parts have again been given the same reference numbers. It can be seen that a door 58 is provided in approximately the longitudinal center of the barrier section 14. In the area of the door 58, the guide rail 44 is covered by a covering 60 which allows comfortable access to the ice-rink and can for instance be swung away when the ice-treatment device is driven along the guide rails.

The ice-treatment device is connected to fixed connections by means of flexible supply leads. The supply leads can include both the cables for supplying the electric motors 46 and also water hoses for supplying the distributing device 22,24.

Figure 6:
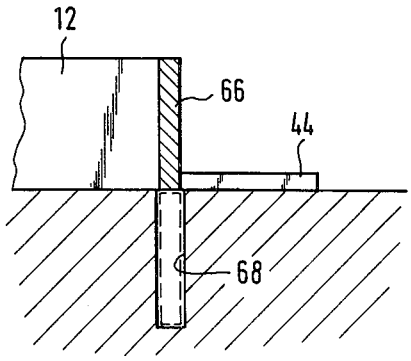
FIG. 6 is a diagrammatic section taken along the line VI—VI in FIG. 5.

FIG. 6 shows the special case where the barrier section 66, which runs parallel to the barrier section 50, can be lowered into the floor of the ice-rink. To achieve this, an excavation 68 must be provided in the floor, into which the barrier section 66 can be lowered in accordance with the position shown in dotted line. This enables the ice-treatment device to drive off the rink 10 without having to be raised above the barrier of the rink.

I claim:

1. In a mobile device for preparing the surface of ice-rinks, especially artificial ice-rinks with a substantially rectangular rink, having at least one ice-scraping device for the mechanical smoothing of the ice surface and a distributing device for the even application of a film of water on the mechanically smoothed ice surface, the improvement that an ice-scraping device and a distributing device are mounted on a framework which extends substantially parallel to a first rink edge across the whole rink and is slidingly guided at its axial ends along two other second rink edges running substantially at right angles to the first rink edge.

2. A device, according to claim 1, wherein the framework is carried with its axial ends on supports which can travel parallel to the second rink edges.

3. A device, according to claim 2, wherein the supports are carried by rail wheels on guide rails which are laid parallel to the second rink edges.

4. A device, according to claim 1 or claim 2, wherein the framework is mounted in height-adjustable manner on the supports.

5. A device, according to claim 1, connected to fixed supply connections by means of flexible supply leads.

6. A device, according to claim 1, comprising a drive arrangement for driving selectively the device and the height adjustment of the framework at the supports, said drive arrangement having at least one electric motor.

7. A device, as claimed in claim 1, wherein said ice-scraping device has at least one blade arranged substantially parallel to said first rink edge.

8. A device, as claimed in claim 7, comprising a collecting arrangement for collecting material scraped off by said ice-scraping device.

9. A device, as claimed in claim 1, wherein said distributing device has a spreader extending across the ice rink parallel to said first rink edge and made of absorbent material, and wherein a sprinkling or spraying device is mounted above said spreader for saturating the spreader with water.

* * * * *